United States Patent [19]

Iiams

[11] 4,081,193

[45] Mar. 28, 1978

[54] TONGS FOR GRIPPING THIN GLASS SHEETS

[75] Inventor: George A. Iiams, Tiro, Ohio

[73] Assignee: PPG Industries, Inc., Pittsburgh, Pa.

[21] Appl. No.: 787,826

[22] Filed: Apr. 15, 1977

[51] Int. Cl.[2] ..... B66C 1/48

[52] U.S. Cl. ..... 294/118

[58] Field of Search ..... 294/86 R, 101, 106, 294/114, 118, 119, DIG. 1, DIG. 2

[56] References Cited

U.S. PATENT DOCUMENTS

| | | | |
|---|---|---|---|
| 3,084,969 | 4/1963 | Davidson et al. | 294/118 |
| 3,089,727 | 5/1963 | Hay | 294/118 |
| 3,363,930 | 1/1968 | Webb | 294/118 |
| 3,392,006 | 7/1968 | Seymour | 294/118 X |

*Primary Examiner*—Johnny D. Cherry
*Attorney, Agent, or Firm*—Edward I. Mates

[57] ABSTRACT

Tongs specially adapted for gripping thin glass sheets (4.5 millimeters and less) during thermal processing.

7 Claims, 5 Drawing Figures

TONGS FOR GRIPPING THIN GLASS SHEETS

BACKGROUND OF THE INVENTION

This invention relates to supporting glass sheets and specifically refers to an improved construction of tongs for gripping thin glass sheets during thermal treatment. Tongs have been used for supporting glass sheets in an essentially vertical plane for thermal treatment by gripping the opposite glass sheet surfaces near their upper edges. The tongs are supported from an overhead rail which extends through thermal treatment apparatus by means of a supporting clevis mounted to a carriage that rides on the rail.

During thermal treatment, the glass sheets are heated as uniformly as possible to an elevated temperature required for subsequent treatment. In tempering, the subsequent treatment involves uniform quenching of the heat-softened glass sheets as uniformly as possible. Glass gripping tongs have been provided with glass engaging elements as small as possible in order to minimize the localized obstruction to the flow of the quenching fluid.

Since glass sheets are heated to substantially the softening point during thermal treatment required for tempering or for certain coating procedures, and since tongs for gripping glass sheets are provided with glass engaging elements that penetrate the heat-softened glass sheet surfaces and mar the latter, particularly when the glass sheets are relatively thin so that they require more intensive heating to arrive at a subsequent treatment station at a temperature suitable for the subsequent treatment, a need has existed for tongs with glass engaging elements that do not penetrate the opposite surfaces of the glass sheet as deeply as the prior art tongs.

Disc-shaped glass engaging elements have been used successfully on glass gripping tongs for thermal treatment of glass sheets of previous commercial thicknesses (at least 4.8 millimeter) with reduced tong marking and penetration. However, the prior art tongs needed larger diameter discs to grip thinner glass sheets properly than the discs provided previously to grip glass sheets of greater thickness. The larger sized discs interfered with the flow of quenching fluid against the glass sheet surfaces in the vicinity of the disc-shaped glass engaging elements. This interference in free flow of quenching fluid caused lower compression stresses in the glass sheets in the vicinity of the glass engaging elements than elsewhere in the cooled glass, thus leading to weak regions.

Glass sheets are usually shaped between a pair of complementary pressing members that require clearances for the glass gripping tongs during the shaping operation. The thinner the glass sheet undergoing shaping, the more critical are the requirements for maximum size of notches or openings in the glass sheet shaping members. When the clearance notches normally provided in press bending molds are too large, the control of the shape of the glass sheets is lost in the vicinity of the notches. This produces glass sheets that do not conform to the specifications established by the customer. Glass sheets that deviate from curvature to a great extent are difficult to install.

DESCRIPTION OF THE PRIOR ART

U.S. Pat. No. 3,089,727 to Hay shows self-closing glass sheet gripping tongs provided with a pair of opposed glass sheet engaging elements in the form of disc-shaped members having smooth, peripheral edge surfaces opposing one another, and carried on the bottom of mutually pivoted lever arms. Means are provided on each lever arm, preferably in the form of a vertical pin secured to a horizontal arm extending beyond the common pivot pin of the tong arms, to pivot the disc-shaped member freely about the vertical pin or shaft. According to one embodiment of the invention of the Hay patent, the disc-shaped members that engage the glass sheet surfaces have a circular periphery. According to another embodiment of the invention patented by Hay, each of the disc-shaped members that engage the glass may include a relatively flat glass engaging portion.

SUMMARY OF THE INVENTION

The present invention provides further improvements in self-closing tongs for gripping glass sheets.

Among these improvements is a modified disc construction for the glass engaging elements comprising a periphery having a pair of essentially diametrically opposite convexly curved peripheral portions interconnected by straight peripheral portions to enable the tongs to be received within smaller notches in the upper portion of glass shaping molds designed for shaping thinner glass sheets than prior art commercial thicknesses so as to minimize the unsupported portion of thin glass sheets during press bending. Another feature of the invention is to provide tongs to be used to grip glass sheets of less thicknesses than previous commercial thicknesses that have glass engaging elements constructed and arranged to cause less obstruction to the free flow of quenching fluid than one would expect from disc-shaped glass engaging elements of the prior art. Still another feature is the manner of mounting the glass engaging elements to the tongs in such a manner that the straight peripheral portions are maintained out of glass sheet contact while one or the other convexly curved peripheral portion engages a major surface of a gripped glass sheet and is free to rotate a limited amount while in peripheral engagement with the engaged major glass sheet surface.

These and other benefits of the present invention will be readily understood after reading the description of a preferred embodiment of the present invention that follows.

BRIEF DESCRIPTION OF THE DRAWINGS

In the drawings that form part of a description of the present invention, wherein like reference numbers refer to like structural elements.

DESCRIPTION OF THE PREFERRED EMBODIMENT

Figure 1:
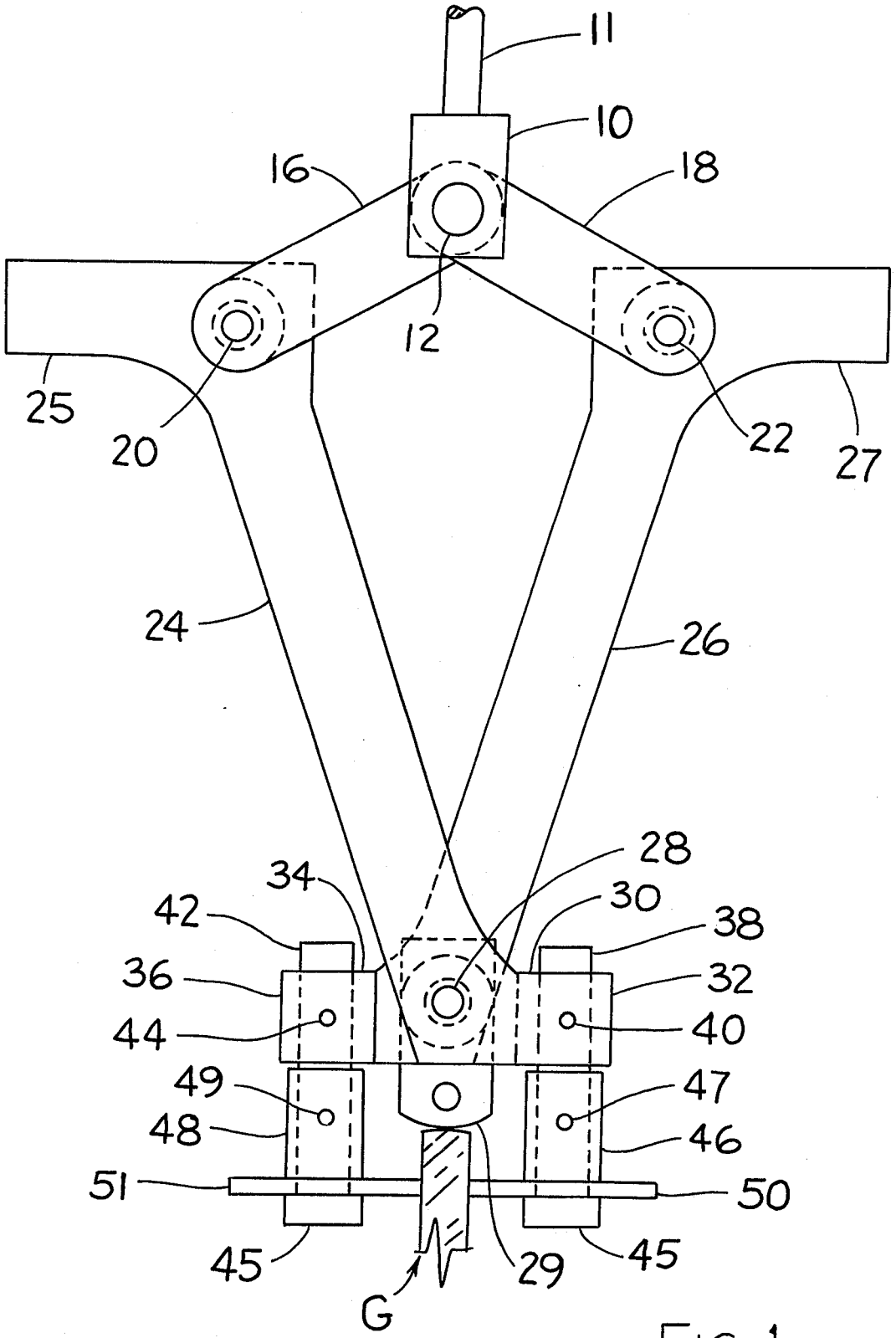
FIG. 1 is an elevational view of a preferred embodiment of tongs constructed according to the present invention.
Figure 2:
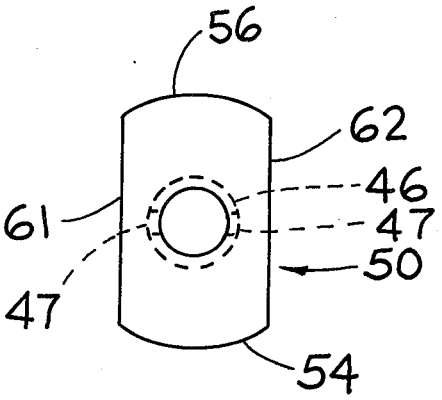
FIG. 2 is a top plan view of one of the glass engaging elements of the tongs of FIG. 1.
Figure 3:
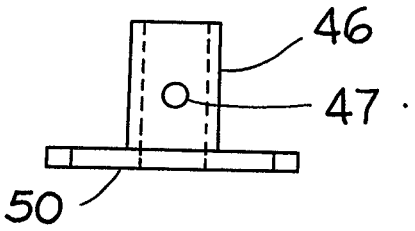
FIG. 3 is a side elevational view taken at a right angle to the view of FIG. 2 showing the glass engaging element of FIG. 2.

Referring to the drawings, reference number 10 refers to an apertured clevis connected by a connecting rod 11 to a carriage (not shown). The latter is movably supported on a monorail (not shown) which extends through a heating furnace and a fluid imparting apparatus, which may be either an air quenching station for tempering apparatus or a fluid spraying station for apparatus imparting a coating to the glass surface. Since the heating furnace and the quenching or spraying stations are not part of the present invention, they will not be described in detail.

The clevis aperture provides a support for a tong support pin 12 which is carried thereby. A pair of upper links 16 and 18 are pivoted to tong support pin 12 at their upper ends. At their bottom ends, links 16 and 18 carry one of a pair of link pins 20 and 22. Tong arms 24 and 26 are apertured at their upper portions to receive one or the other of the link pins 20 and 22. Link pin 20 pivotally attaches the upper portion of tong arm 24 to the lower portion of upper link 16, whereas link pin 22 pivotally secures the lower portion of upper link 18 to the upper portion of tong arm 26.

Tong arm 24 has a horizontally extending finger 25 and tong arm 26 has a horizontally extending finger 27 for use in automatically unloading glass sheets from the tongs. Details of this unloading feature are recited in U.S. Pat. No. 3,084,969 to Davidson and Mitchell, the description of which is incorporated herein by reference.

A common hinge pin 28 pivotally secures tong arms 24 and 26 to each other at their lower portion. In addition, an apertured stop member 29 having a convexly rounded lower edge is pivoted to the common hinge pin 28 between the tong arms 24 and 26 to limit the uppermost position possible for the glass sheet G within the tongs. Further details of this feature and the benefits thereof are found in U.S. Pat. No. 2,991,114 to Robinson, the description of which is incorporated herein by reference. The bottom portion of tong arm 24 comprises an extension 30 constructed to terminate in a vertically apertured, lower tong end portion 32. Similarly, the bottom portion of tong arm 26 comprises an extension 34 that is constructed to terminate in a vertically apertured, lower tong end portion 36.

Figure 4:
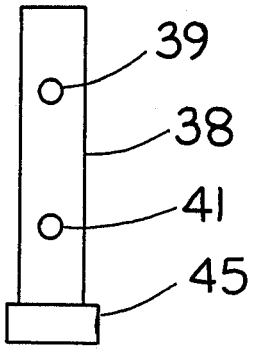
FIG. 4 is an elevational view of an apertured pin forming another structural element included in the tongs of the present invention.
Figure 5:
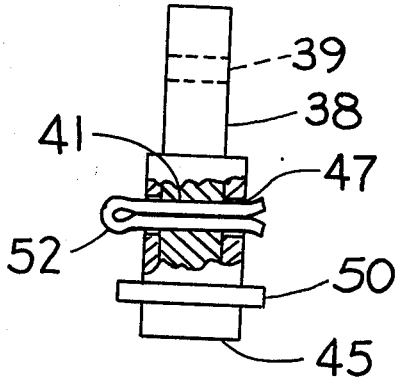
FIG. 5 is an elevational view, partly in section, showing how the glass engaging element of FIGS. 2 and 3 is supported on the apertured pin of FIG. 4 when the tong is assembled for service.

A vertical pin 38 is received within end portion 32. Pin 38 is diametrically apertured with an upper aperture 39 (FIG. 4) for alignment with a pair of diametrically aligned, horizontal apertures 40 in end portion 32 and a lower aperture 41, whose use will be described later. Thus, pin 38 is fixed to end portion 32 by a cotter key (not shown) extending through the aligned apertures 39 and 40. A diametrically apertured vertical pin 42 is secured to the end portion 36 by means of a cotter key (not shown) extending through horizontally aligned apertures 44 of end portion 36 in a similar manner to that by which pin 38 is secured to end portion 32. Each pin 38 and 42 has an enlarged lower portion 45.

An apertured sleeve 46 is concentrically mounted about pin 38 below the extension 30 and is provided with diametrically aligned apertures 47. Similarly, another apertured sleeve 48 is likewise mounted about pin 42 below the extension 34 and is provided with similar diametrically aligned apertures 49.

An apertured element 50 having a smoothly surfaced periphery of modified disc-like configuration is concentrically attached to the bottom of sleeve 46. Similarly, an identical element 51, also of modified disc-like configuration, is concentrically attached to the bottom of sleeve 48.

Each of the sleeves 46 and 48 is provided with a pair of diametrically opposed, horizontally aligned apertures 47 and 49, respectively, adapted for alignment with the lower apertures 41 of the vertical pins 38 and 42. Each cotter pin 52 of a pair of cotter pins is adapted to extend through the respective horizontally aligned apertures 47 or 49 of sleeves 46 or 48 and through the lower apertures 41 of the vertical pins 38 or 42 to secure the respective sleeves 46 and 48 in desired orientation relative to the vertical pins 38 and 42.

The elements 50 and 51 are concentrically mounted with respect to the supporting sleeves 46 and 48 in such a manner that they are provided with diametrically opposite, convexly curved peripheral portions 54 and 56 interconnected by straight sides 61 and 62. The periphery of the glass engaging elements 50 and 51 has segments missing from the circular disc typical of the Hay patent mentioned in the statement of the prior art earlier in this specification. The cotter pins 52 serve as means for supporting the glass engaging members 50 and 51 in one of two possible predetermined orientations relative to the tongs so that convexly rounded peripheral portions of the glass engaging elements oppose one another to engage a gripped glass sheet therebetween. The flat missing peripheral portions 61 and 62 are out of contact with the gripped glass sheet.

The cotter pins 52 are so arranged relative to the aligned horizontal apertures 41 of the vertical pins 38 and 42 and with the respective lower apertures 47 and 49 of apertures sleeves 46 and 48 that they make tight fits with apertures 41 and looser fits with the apertures 47 and 49. This arrangement enables the glass engaging elements to be oriented with their rounded peripheral portion 54 ot 56 engaging a major surface of a gripped glass sheet depending on how the glass engaging elements 50 and 51 are oriented and the shorter dimension between the straight peripheral portions 61 and 62 are simultaneously oriented with the length of notches on press bending molds in case the treatment for the tong-gripped glass sheet G includes a press bending step.

In the orientations resulting from inserting the cotter pins 52 through the apertures 47 or 49 and lower pin apertures 41, a slight degree of freedom of rotation is permitted the elements 50 and 51 that comprise the glass sheet engaging elements of the tongs. In the illustrative embodiment of this invention, this slight rotation is provided by making the cotter pins 52 fit tightly in apertures 41 of rods 38 and 42 and loosely through the aligned apertures 47 and 49 of the sleeves 46 and 48. This is accomplished by drilling the apertures 41 with a #50 drill to provide diameters of 70 mils (17.8 millimeters) and drilling the apertures 47 and 49 with a #48 drill to provide diameters of 76 mils (19.3 millimeters).

By modifying the disc-shaped configuration of prior art tongs to the presently described configuration, the preferred embodiment of the present invention provides less interference with the flow of tempering medium such as cold air blasts against the opposite surfaces of the glass sheet G that is gripped by the tongs, particularly in the vicinity of the glass engaging elements 50 and 51. Furthermore, the absence of segments from the disc-shaped tongs of the prior art improves the ability of the glass sheet in the vicinity of the glass engaging elements to be heated more consistently with the heating of the remainder of the body of the glass than is the case with relatively massive glass engaging elements of the prior art. Furthermore, the circular discs of the prior art provided more interference with the free flow of tempering medium of air blasts in the quenching station. Hence, the tendency of the glass to develop weaknesses, such as vents that tend to cause fracture in the production of tempered glass sheets, is reduced considerably compared to the breakage experienced prior to the present invention. In addition, having front end and rear end segments missing from the prior art disc-shaped glass engaging elements makes it easier to align the smaller dimension of the glass engaging elements in smaller notches provided on press bending molds for shaping thin glass sheets.

The benefits of the present invention were determined in several production tests. In one test where the production facility was press bending and tempering side lights having a nominal thickness of 5/32 inch (approximately 4 millimeters nominal thickness), 22.7 percent of production glass sheets developed vents when processed with tongs provided with circular discs as the glass engaging elements. A test of approximately 20,000 pieces involving six different patterns using the modified tongs having cut-down tong discs provided no vents whatsoever.

Furthermore, preliminary tests on processing parts having a thickness of ⅛ inch verified this reduction in tong vents that radiated out from the tong marks. This reduction in tong vents for processing glass sheets of ⅛ inch (nominal 3 millimeter) thickness and the complete elimination of tong venting in a production facility producing commercial parts having a nominal thickness of 5/32 inch (nominally 4 millimeters) provided proof positive of the benefits of the present invention.

An important feature of the glass engaging elements of the present invention is that they are concentrically pivoted for very limited rotation about a substantially vertical axis so that in one permitted orientation one convexly curved peripheral portion makes contact with a major glass sheet surface. When turned to an orientation approximately 180 degrees opposite from the first orientation, an essentially diametrically opposite convexly curved peripheral portion makes contact with said major surface of said glass sheet. In both of the permitted orientations, the flat peripheral portions are prevented from making contact with said major glass surface. When one convexly curved peripheral portion becomes worn, the cotter pins 52 can be removed, the elements 50 and 51 rotated approximately 180° and the cotter pins 52 reinserted through the aligned apertures 47 or 49 of sleeves 46 or 48 and apertures 41 of the pins 38 and 42, thus doubling the productive life of the glass engaging elements 50 and 51.

This disclosure represents a description of a preferred embodiment and various modifications thereof. It is understood that various changes may be made without departing from the gist of the invention as defined in the claimed subject matter which follows.

I claim:

1. Self-closing tongs for gripping a glass sheet during thermal processing comprising a pair of glass engaging elements of modified disc-like configuration carried by said tongs and movable into glass engaging positions against the opposite major surfaces of said glass sheet when said tongs are freely suspended, each of said glass engaging elements having a periphery comprising a pair of diametrically opposite convexly rounded peripheral portions interconnected by straight portions, element supporting means carried by the lower portion of said tongs for supporting each said element including pin means about which said element is mounted about its approximate geometrical center, and element orienting means cooperating with said element supporting means to support its said associated element in one of two approximately diametrically opposed orientations so that one of said convexly rounded peripheral portions of each of said glass engaging elements opposes one of said convexly rounded peripheral portions of said other glass engaging element to engage said gripped glass sheet therebetween and the straight peripheral portions of said elements are out of contact with said gripped glass sheet.

2. Self-closing tongs as in claim 1, wherein said elements are pivotally supported relative to their respective pin means in such a manner as to permit limited pivotal rotation therebetween.

3. Self-closing tongs as in claim 1, wherein said tongs comprise a pair of tong arms, each tong arm comprising an upper tong arm portion and a vertically apertured, lower tong arm portion, means pivotally connecting said tong arms together intermediate said upper tong arm portions and said lower tong arm portions, each of said glass engaging elements being supported in one of two predetermined orientations relative to a vertical pin attached to one or the other of said lower tong arm portions and means for permitting said glass engaging elements to pivot freely a limited amount relative to pivot axes defined by said vertical pins.

4. Self-closing tongs as in claim 3, wherein each of said vertical pins has an upper horizontal aperture and a lower horizontal aperture, said lower tong arm portions each have an end portion with aligned horizontal apertures adapted to be aligned with and secured to said upper horizontal aperture of an associated vertical pin, and each said glass engaging element is concentrically mounted on the lower end of a sleeve surrounding one or the other of said vertical pins, each said sleeve having a pair of diametrically aligned horizontal apertures adapted to be aligned with and secured to said lower horizontal aperture of its said associated vertical pin, and a pin extending through each of said aligned apertures.

5. Self-closing tongs as in claim 4, wherein said pins comprise a cotter pin extending through each of said upper aligned apertures and a cotter pin extending through each of said lower aligned apertures.

6. Self-closing tongs as in claim 5, wherein said lower pin apertures have a different diameter than the apertures of their corresponding sleeves and said cotter pins are constructed to have a relatively tight fit with said apertures of smaller diameter and a relatively loose fit with said apertures of larger diameter.

7. Self-closing tongs as in claim 6, wherein said cotter pins are constructed to have a relatively tight fit with said lower pin apertures and a relatively loose fit with said sleeve apertures.

* * * * *